US007980323B2

(12) United States Patent
Wilson

(10) Patent No.: US 7,980,323 B2
(45) Date of Patent: Jul. 19, 2011

(54) SHOCK DAMPENING POST DRIVER

(76) Inventor: Robert Wilson, Lake Ozark, MO (US)

( * ) Notice: Subject to any disclaimer, the term of this patent is extended or adjusted under 35 U.S.C. 154(b) by 0 days.

(21) Appl. No.: 11/867,669

(22) Filed: Oct. 4, 2007

(65) Prior Publication Data

US 2009/0090527 A1 Apr. 9, 2009

(51) Int. Cl.
*B25D 17/24* (2006.01)

(52) U.S. Cl. ..... 173/162.1; 173/162.2

(58) Field of Classification Search ..... 173/162.1, 173/162.2, 213, 118, 90, 91; 16/431; 405/232; 30/166.3, 312, 340, 381
See application file for complete search history.

(56) References Cited

U.S. PATENT DOCUMENTS

| | | | | | |
|---|---|---|---|---|---|
| 299,086 | A | | 5/1884 | Over | |
| 1,859,398 | A | * | 5/1932 | Judd | 173/118 |
| 2,098,146 | A | | 11/1937 | Hunt | |
| 2,998,087 | A | | 8/1961 | Iddings | |
| 3,313,356 | A | | 4/1967 | Clevenger | |
| 3,409,056 | A | * | 11/1968 | Rauh | 30/381 |
| 3,637,029 | A | * | 1/1972 | Sherwood et al. | 173/162.2 |
| 3,712,389 | A | | 1/1973 | Smoak | |
| 3,735,822 | A | * | 5/1973 | Deike | 173/118 |
| 3,747,690 | A | * | 7/1973 | Deike | 173/118 |
| 3,792,739 | A | * | 2/1974 | Deike | 173/118 |
| 3,945,119 | A | * | 3/1976 | Nagashima et al. | 30/383 |
| 4,102,410 | A | * | 7/1978 | Ross | 173/133 |
| 4,494,612 | A | | 1/1985 | Bell | |
| 4,667,749 | A | * | 5/1987 | Keller | 173/162.2 |
| 4,898,039 | A | * | 2/1990 | Aiyama et al. | 74/6 |
| 4,971,479 | A | | 11/1990 | Byers et al. | |
| 5,020,605 | A | | 6/1991 | Leishman | |
| 5,029,651 | A | | 7/1991 | Ubbink | |
| 5,042,591 | A | | 8/1991 | Hull | |
| 5,097,912 | A | | 3/1992 | Bowers | |
| 5,502,910 | A | | 4/1996 | Lucchesi | |
| 5,806,608 | A | | 9/1998 | DuBois | |
| 5,921,327 | A | * | 7/1999 | Henriksson et al. | 173/210 |
| 5,921,530 | A | | 7/1999 | Joyce et al. | |
| 7,089,694 | B2 | | 8/2006 | Allen | |

OTHER PUBLICATIONS

Gempler's, Inc., Dead-Blow Post Driver Item No. 69200, Catalog dated Mar. 21, 2003.
Hoover Fence Co., Hand Post Driver Ft-P6, www.hooverfence.com, web page dated Mar. 21, 2003.
REM Driver, Sign-Post Driver, www.remdriver.com, web page dated Mar. 21, 2003.
Ken Cove, Farm Fence Post Driver, www.kencove.com, web page dated Nov. 13, 2002.
Behlen Manufacturing Co., Post Driver, www.behlencountry.com, web page dated Mar. 21, 2003.

* cited by examiner

*Primary Examiner* — Paul R Durand
*Assistant Examiner* — Nathaniel Chukwurah
(74) *Attorney, Agent, or Firm* — Husch Blackwell LLP

(57) ABSTRACT

A post driver having a dampening device adapted to isolate the hands and arms of the user from shock.

14 Claims, 3 Drawing Sheets

SHOCK DAMPENING POST DRIVER

BACKGROUND OF INVENTION

1. Field of Invention

The present invention relates to a post driver. More specifically, the present invention relates to a vibration dampening post driver for driving posts into the ground more comfortably and with less risk of injury.

2. Background Art

Fences have been used to mark territorial boundaries, prevent trespassers from entering a property, and contain livestock. These fences require that hundreds or thousands of posts be driven into the ground at regular or evenly spaced intervals. Historically, fence builders used large hammers to drive posts, though this was backbreaking—and often dangerous—work.

There have been some advances in the post driving art area. Cylindrical post driving devices, such as that shown in Hunt, U.S. Pat. No. 2,098,146—including a post tube, which is open only at the bottom of the tube, and handles on both sides of the tube—were invented long ago. In use, these post driving devices were positioned with the open end of the tube over the post, grasped at the handles, and repeatedly driven down so that the closed top end of the tube impacted the top of the post, driving the post into the ground.

However, these traditional post driving devices caused a great deal of vibration and tended to be very jarring to the hands and wrist of the user. Users of these post driving devices often experienced pain in their arms and back and typically experienced discomfort in their hands after repeated use.

More recent advances in the area included the use of springs located inside and at the top of the post tube, also known as a driver housing, to somewhat dampen the force of the blow received when the posts are driven into the ground, such as that shown in Iddings, U.S. Pat. No. 2,998,087, and Bowers, U.S. Pat. No. 5,097,912. However, these newer post driving devices with springs internal to the post tube are limited in that the size and number of springs utilized is limited, and thus the dampening ability is minimal. While better than traditional post driving devices that have little or no impact dampening abilities, even these newer post driving devices do not contain sufficient impact dampening capabilities for many people who need to drive a large number of posts. Also, the location of the dampening spring is not effective for dampening the forces transferred from the handles to the hands or wrist of the user.

Consequently, a need has long been felt for a post driving device with better dampening abilities to better cushion the jarring impact of driving posts into the ground.

BRIEF SUMMARY OF THE INVENTION

One or more of the embodiments of the present invention provide for an impact dampening post driving device which includes a shaft having an interior cavity extending to a downward facing opining or openings at a distal end of said shaft. Brackets are physically mounted onto the outside of the shaft for attaching the handles to the shaft. The handles are attached to the bracket by a floating mount. The floating mount allows for a dampening device or spring to be positioned between the handle attach points, or mounting flanges, and the brackets. For example, in one embodiment the mounting flange of a handle has an oversized aperture, and the bracket has a similarly sized aperture where the mounting flange is floatingly mounted to the bracket by threading an undersized bolt through the apertures and capturing the bolt with a nut larger than said apertures. A dampening device is then positioned within the floating region between the bracket and mounting flange. In this way, a dampening spring sits between each handle and the shaft, as opposed to the handles being mounted directly to the shaft.

The dampening device or dampening spring by definition can be any elastic device or shock absorbing device, such as for example, but not limited to a bushing made of elastomeric material or a coiled spring or any other elastic device that substantially regains its original shape after compression or extension.

A user can grasp the handles and lift the device over a post such that the post is aligned with the opening at the bottom of the shaft. The user can then force the shaft down over the post such that the post enters the interior cavity through the downward facing opening and strike the closed top end of the shaft. This creates vibration and shock in the shaft, but the dampening springs between the shaft and the handles greatly reduce the vibration and shock reaching the handles held by the user, thus reducing the force transferred to the hands, arms and wrist of the user.

BRIEF DESCRIPTION OF THE DRAWINGS

For a better understanding of the present invention, reference may be made to the accompanying drawings in which.

DETAILED DESCRIPTION OF THE INVENTION

A shock-dampening post driving device, according to an embodiment of the present invention, includes a shaft having an axially extending interior cavity that extends to a closed top end of the shaft and to a distal open bottom end of the shaft. The closed top end of the shaft forms a striking surface that is used to strike posts. The shaft also has a first mounting bracket extending from an exterior wall of the shaft. Additionally, an upper mounting flange of a handle is mounted to the first mounting bracket of the shaft by a first floating mount with a first floating region. Further, a first dampening spring is positioned between the upper mounting joint of the handle and the first mounting bracket. This first dampening spring extends into the first floating region, where it dampens vibration between the shaft and the handle.

Another embodiment of a shock-dampening post driving device includes a handle mounted to a shaft by a first floating mount having a first floating region, where the first floating mount allows the handle to float or oscillate within said first floating region. Additionally, a first dampening spring is positioned between the handle and the shaft, where the first dampening spring extends into the first floating region, and where the first dampening spring dampens vibration between the shaft and the handle.

An embodiment of a shock-dampening post driving method includes striking an object with [a closed top end of] a shaft [while said object is in an axially extending interior cavity of said shaft] and dampening vibration between the shaft and a handle. The handle is floatingly attached to the shaft by a floating mount, and the dampening occurs in a dampening spring positioned in a floating region of the floating mount between said handle and said shaft.

Figure 1:
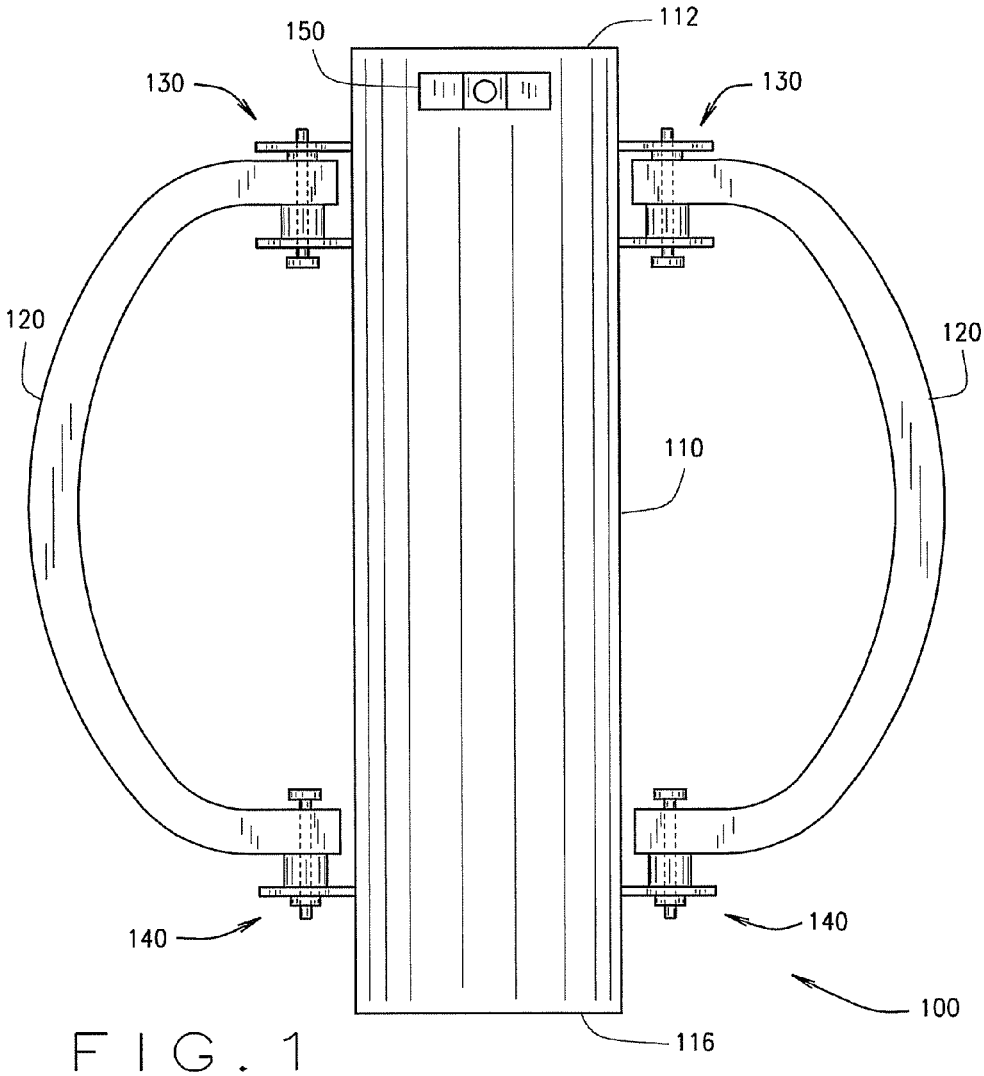
FIG. 1 is an elevation view of the post driving device.
Figure 2:
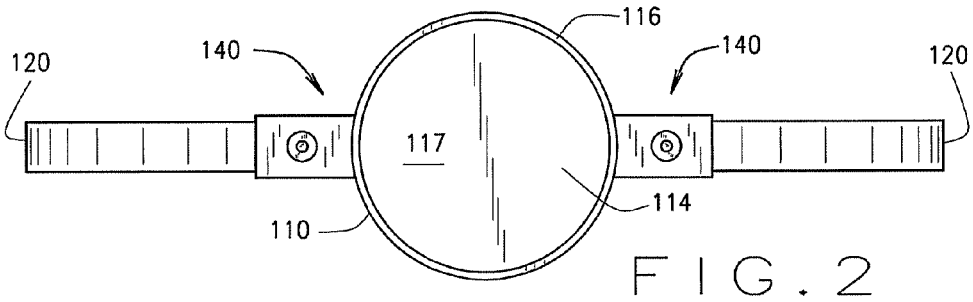
FIG. 2 is a bottom view of the post driving device shown in FIG. 1.

FIGS. 1 and 2 illustrate multiple views of a post driving device 100 according to a preferred embodiment of the present invention. As shown in FIG. 1, the post driving device 100 includes a cylindrical shaft 110 having a closed top end 112 forming a striking surface 117, and an axially extending interior cavity 114 extending to a distal open bottom end 116. The post driving device 100 of FIG. 1 further includes two handles 120, two upper dampening assemblies 130, two lower dampening assemblies 140, and a level 150.

Each handle 120 is physically connected to an upper dampening assembly 130 and a lower dampening assembly 140. Both upper dampening assemblies 130 are physically mounted to the cylindrical shaft 110 toward the top end 112 of the cylindrical shaft 110. Both lower dampening assemblies 140 are physically mounted to the cylindrical shaft 110 toward the bottom end 116 of the cylindrical shaft 110. The level 150 is physically mounted proximate the top end 112 of the cylindrical shaft 110. The axially extending interior cavity 114 is inside the cylindrical shaft 110 and extends to the open bottom end 116.

In operation, a post is held vertically on the spot where it is to be driven into the ground. The open bottom end 116 of the cylindrical shaft 110 is then placed over the top end of the post, and the post is allowed to slide up through the open bottom end 116 of the cylindrical shaft 110 into the axially extending interior cavity 114 of the cylindrical shaft 110 until the top of the post comes to rest against the closed top end 112 of the cylindrical shaft 110. The level 150 in the cylindrical shaft 110 then alerts the user if the post is currently perpendicular to the ground The user of the post driver device 100 grasps the handles 120, one in each hand, and lifts the post driver device 100. Once the post driver device 100 has been sufficiently lifted, the user quickly forces the post driver device 100 downward onto the post, such that the post again slides up through the open bottom end 116 of the cylindrical shaft 110 into the axially extending interior cavity 114 of the cylindrical shaft 110 until the closed top end 112 of the cylindrical shaft 110, which acts as a striking surface, forcefully impacts the top of the post, driving the post into the ground. This impact creates a great deal of vibration and shock in the cylindrical shaft 110 that is transferred to the handles 120. The upper damper assemblies 130 and the lower damper assemblies 140 dampen the vibration generated in the cylindrical shaft 110 before the shock and vibration reach the hands and body of the user. The previous post driver designs, which have the handles rigidly mounted to the cylindrical shaft, does not dampen the force transferred to the hands of the user, and the post drivers having the interior springs are not very effective because they only require the user to drive downward with a greater velocity and more force in order to drive a post.

The cylindrical shaft 110 may alternatively have a non-circular cross-section, such as a triangular, rectangular, or pentagonal cross-section, or any other shaped cross-section. The cylindrical shaft 110 may be made of a metal or metal alloy, or other material conducive to repeated impacts. The level 150 may alternatively be mounted anywhere on the post driving device 100, and more levels may be added to give information on more than just one axis. The closed top end 112 of the cylindrical shaft 110 may have some sort of a weight or durable substance with which to exert even more force on a post being driven into the ground. The post driver device 100 may be used to drive things other than posts in directions other than down into surfaces other than the ground. There may alternatively be more or less than two handles 120, and more or less than two upper damper assemblies 130 and two lower damper assemblies 140. Further, handles 120 may alternatively be mounted to more or less than two dampener assemblies 130, 140, though never less than one.

Figure 3:
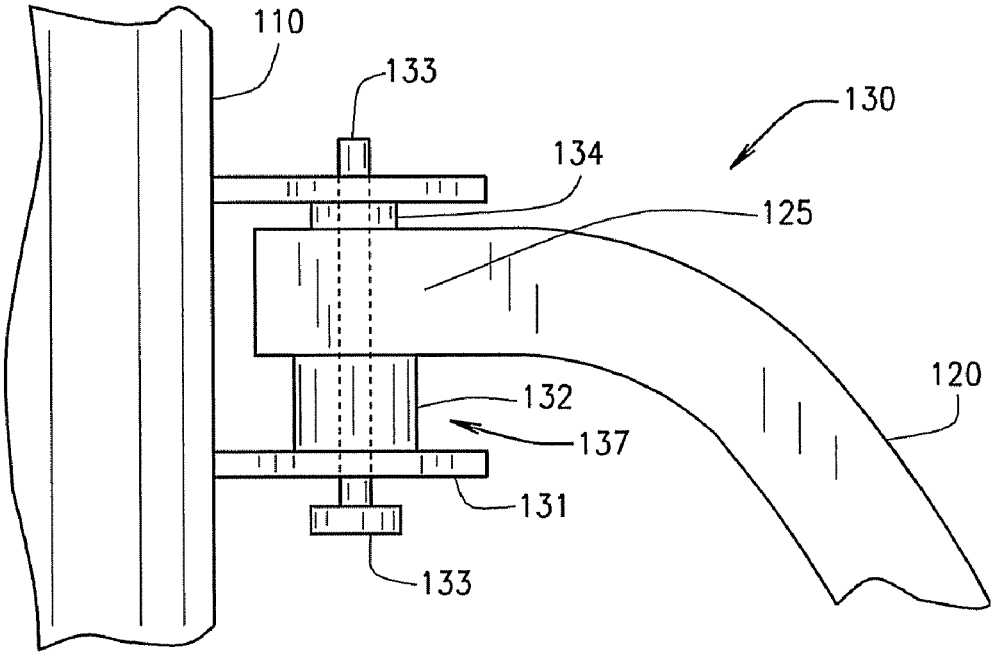
FIG. 3 is a magnified view of the top dampening assembly shown in FIG. 1.

FIG. 3 shows a magnified view of the upper damper assembly 130 according to an embodiment of the present invention. As shown in FIG. 3, the upper damper assembly 130 includes a first mounting bracket 131, a first damper 132, a first bolt 133, a first nut 134, a third mounting bracket 135, and a handle 120 having an upper mounting flange 125 at one end.

The first mounting bracket 131 and the third mounting bracket 135 are affixed to the cylindrical shaft 110. Between the two mounting brackets 131, 135 are, from bottom to top, the first damper 132, the upper mounting flange 125 of a handle 120, and the first nut 134. The first bolt 133 is inserted through an aperture of the first mounting bracket 131 up through an aperture in the first damper 132 and an aperture in the upper mounting flange 125 of a handle 120, and is secured in place by the first nut 134. A portion of the first bolt 133 extends through the first nut 134 and up through an aperture in the third mounting bracket 135. This creates a floating mount between the upper mounting flange 125 of the handle and the brackets 131, 135 attached to the cylindrical shaft 110.

In operation, the first bolt 133 and first nut 134 hold the components of the upper damper assembly 130 in place. The third mounting bracket 135 and first mounting bracket 131 connect the upper damper assembly 130 to the cylindrical shaft 110. The first bolt 133 connects the first damper 132 and the upper mounting flange 125 (and thus the handle 120) to the third mounting bracket 135 and the first mounting bracket 131, while the first nut 134 secures the first bolt 133 in place. The positioning of the components allows the upper mounting flange 125 (and thus the handle 120) to oscillate or float along the first bolt 133 and compress the first damper 132 when the closed top end 112 of the cylindrical shaft 110 is brought down and strikes an object. This dissipates much of the vibration and shock before it can travel from the cylindrical housing 110 to the handles 120. The first damper 132 then rebounds, pushing the upper mounting flange 125 (and thus the handle 120) back to its original position, completing one oscillation. In other words, the floating mount created by this assembly allows the upper mounting flange 125 of the handle 120 to oscillate or float up and down along a floating region 137 in which the damper 132 is installed.

In the alternative, things other than the first bolt 133 and first nut 134 may be used to hold the components of the upper assembly 130 in place in a floating relationship, such as adhesive, rivets, welding or other bonding techniques. The first damper 132 may take the form of dense foam or other elastomeric material or shock absorbing material, or may alternatively be a dampening spring or other mechanical shock absorbing device such as a pneumatic or hydraulic shock absorber. The order of the components in the upper damper assembly 130 may change, such as the position of the first nut 134 moving from under to over the third mounting bracket 135 or any similar change. The first damper 132 size and dampening ability may vary according to the needs of the user.

Figure 4:
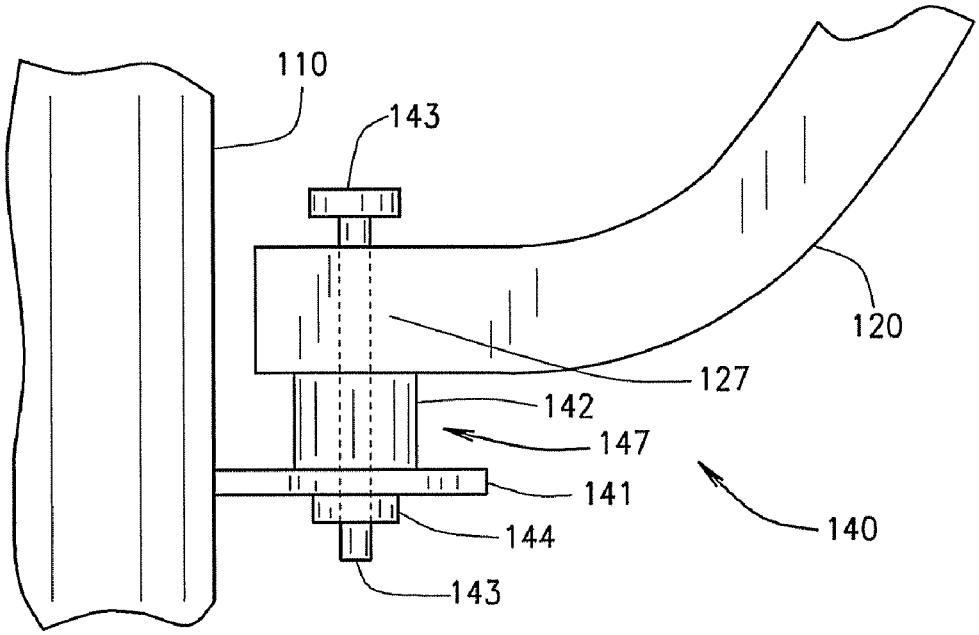
FIG. 4 is a magnified view of the bottom dampening assembly shown in FIG. 1.

FIG. 4 shows a magnified view of the lower damper assembly 140 according to an embodiment of the present invention. As shown in FIG. 4, the lower damper assembly 140 includes a second mounting bracket 141, a second damper 142, a second bolt 143, a second nut 144, and a handle 120 having a lower mounting flange 127 at one end.

The second mounting bracket 141 is connected to the cylindrical shaft 110. Above the second mounting bracket 141 is, from bottom to top, the second damper 142, and the lower mounting flange 127 of the handle 120. The second bolt 143 is inserted down through an aperture in the lower mounting flange 127, through an aperture in the second damper 142 and an aperture in the second mounting bracket 141, and is secured in place by the second nut 144 below the second mounting bracket 141 to a portion of the second bolt 143 extending through an aperture in the second mounting bracket 141. This creates a floating mount between the lower mounting flange 127 of the handle 120 and the second mounting bracket 141 attached to the cylindrical shaft 110.

In operation, the second bolt 143 and second nut 144 hold the components of the lower damper assembly 140 in place. The second mounting bracket 141 connects the lower damper assembly 140 to the cylindrical shaft 110. The second bolt 143 connects the second damper 142 and the lower mounting flange 127 of the handle 120 to the second bracket 141, while the second nut 144 secures the second bolt 143 in place. The positioning of the components allows the lower mounting flange 127 (and thus the handle 120) to oscillate or float along the second bolt 143 and compress the second damper 142 when the closed top end 112 of the cylindrical shaft 110 is brought down and strikes an object. This dampens much of the vibration and shock before it can travel from the cylindrical housing 110 to the handles 120. The second damper 142 then rebounds, pushing the lower mounting flange 127 (and thus the handle 120) back to its original position, completing one oscillation. In other words, the floating mount created by this assembly allows the lower mounting flange 127 of the handle 120 to oscillate or float up and down along a floating region 147 in which the damper 132 is installed.

In the alternative, things other than the second bolt 143 and second nut 144 may be used to hold the components of the lower assembly 140 in place, such as adhesive, rivets, welding or other bonding techniques. The second damper 142 may take the form of dense foam or elastomeric material or shock absorbing material, or may alternatively be a dampening spring or other mechanical shock absorbing device such as a hydraulic or pneumatic shock absorber. The order of the components in the lower damper 140 assembly may change, such as the orientation of the second bolt 144 being flipped 180 degrees such that it is inserted from the top down as opposed to from the bottom up, or any similar change.

Figure 5:
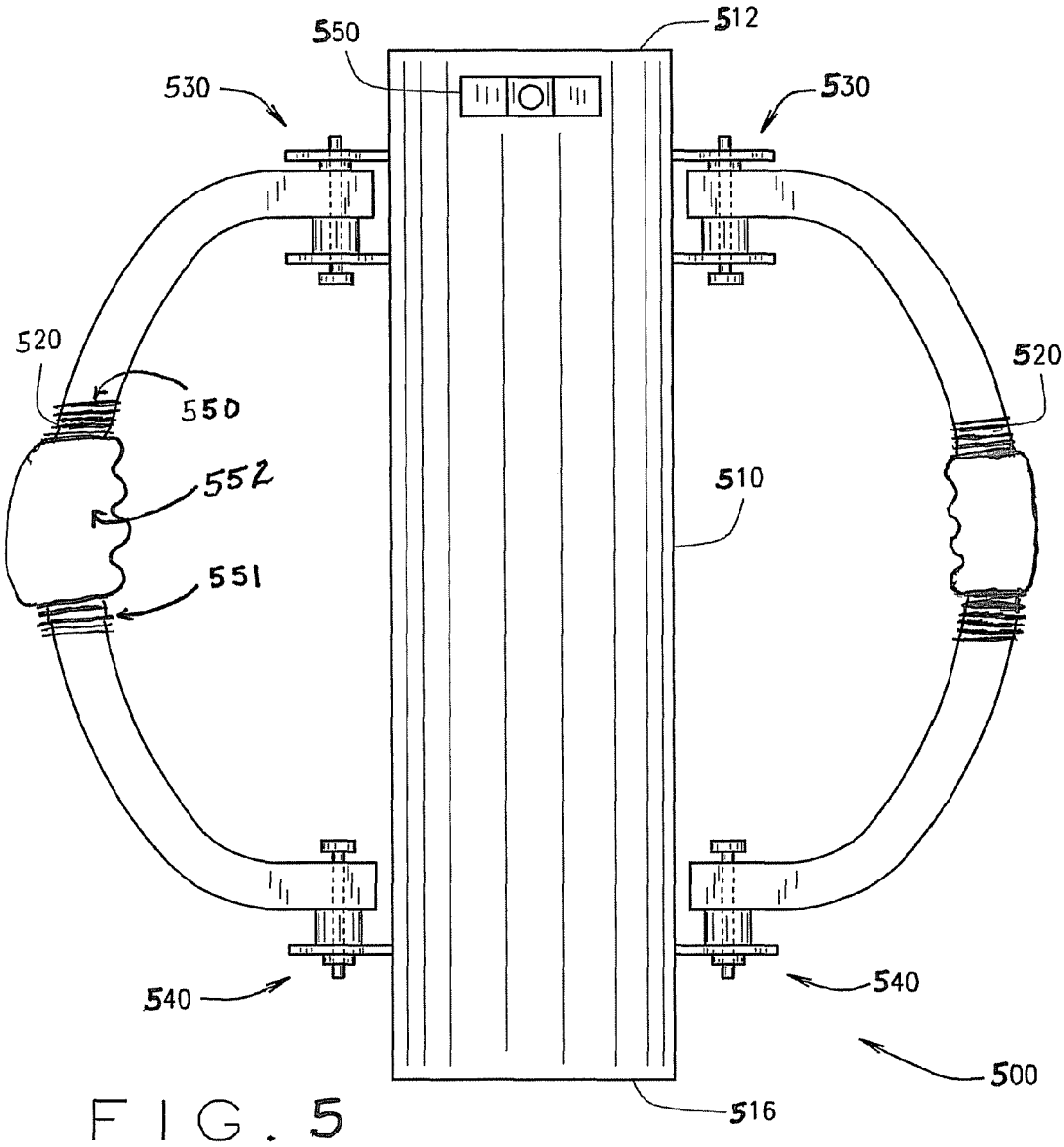
FIG. 5 is an elevation view of an alternative embodiment.
Figure 6:
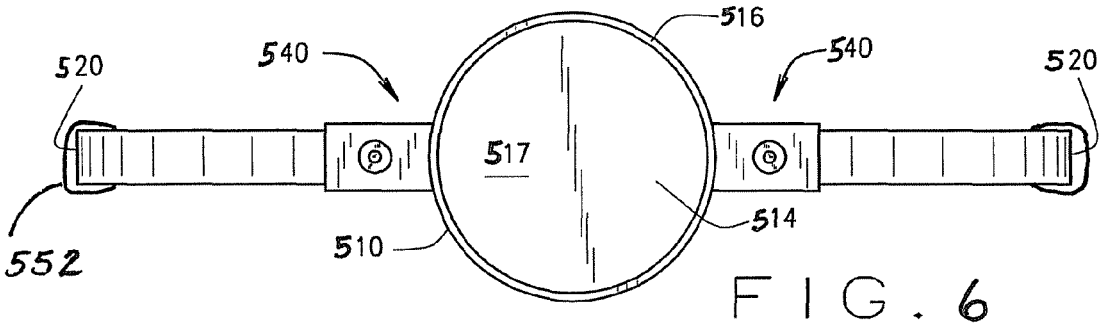
FIG. 6 is a bottom view thereof.

FIGS. 5 and 6 illustrate multiple views of a post driving device 500 according to a preferred embodiment of the present invention. As shown in FIG. 5, the post driving device 500 includes a cylindrical shaft 510 having a closed top end 512 forming a striking surface 517, and an axially extending interior cavity 514 extending to a distal open bottom end 516. The post driving device 500 of FIG. 5 further includes two handles 520, two upper dampening assemblies 530, two lower dampening assemblies 540, and a level 550.

Each handle 520 is physically connected to an upper dampening assembly 530 and a lower dampening assembly 540. Both upper dampening assemblies 530 are physically mounted to the cylindrical shaft 510 toward the top end 512 of the cylindrical shaft 510. Both lower dampening assemblies 540 are physically mounted to the cylindrical shaft 510 toward the bottom end 516 of the cylindrical shaft 510. The level 550 is physically mounted proximate the top end 512 of the cylindrical shaft 510. The axially extending interior cavity 514 is inside the cylindrical shaft 510 and extends to the open bottom end 516.

In operation, a post is held vertically on the spot where it is to be driven into the ground. The open bottom end 516 of the cylindrical shaft 510 is then placed over the top end of the post, and the post is allowed to slide up through the open bottom end 516 of the cylindrical shaft 510 into the axially extending interior cavity 514 of the cylindrical shaft 510 until the top of the post comes to rest against the closed top end 512 of the cylindrical shaft 510. The level 550 in the cylindrical shaft 510 then alerts the user if the post is currently perpendicular to the ground The user of the post driver device 500 grasps the handles 520, one in each hand, and lifts the post driver device 500. Once the post driver device 500 has been sufficiently lifted, the user quickly forces the post driver device 500 downward onto the post, such that the post again slides up through the open bottom end 516 of the cylindrical shaft 510 into the axially extending interior cavity 514 of the cylindrical shaft 510 until the closed top end 512 of the cylindrical shaft 510, which acts as a striking surface, forcefully impacts the top of the post, driving the post into the ground. This impact creates a great deal of vibration and shock in the cylindrical shaft 510 that is transferred to the handles 520. The upper damper assemblies 530 and the lower damper assemblies 540 dampen the vibration generated in the cylindrical shaft 510 before the shock and vibration reach the hands and body of the user. The previous post driver designs, which have the handles rigidly mounted to the cylindrical shaft, does not dampen the force transferred to the hands of the user, and the post drivers having the interior springs are not very effective because they only require the user to drive downward with a greater velocity and more force in order to drive a post.

The cylindrical shaft 510 may alternatively have a non-circular cross-section, such as a triangular, rectangular, or pentagonal cross-section, or any other shaped cross-section. The cylindrical shaft 510 may be made of a metal or metal alloy, or other material conducive to repeated impacts. The level 550 may alternatively be mounted anywhere on the post driving device 500, and more levels may be added to give information on more than just one axis. The closed top end 512 of the cylindrical shaft 510 may have some sort of a weight or durable substance with which to exert even more force on a post being driven into the ground. The post driver device 500 may be used to drive things other than posts in directions other than down into surfaces other than the ground. There may alternatively be more or less than two handles 520, and more or less than two upper damper assemblies 530 and two lower damper assemblies 540. Further, handles 520 may alternatively be mounted to more or less than two dampener assemblies 530, 540, though never less than one. The handle can include a dampening device system 550 and 551 and gripper handle 552 in addition to the damper assembly 130 described above or in lieu of damper assembly 130.

One or more embodiments of the present invention dissipate the vibration and shock that are created by driving posts into the ground more readily than current post drivers through the use of more and bigger and better dampers mounted directly between the handles and cylindrical shaft of the device. This increased shock absorption decreases the strain on the user of the device, which lessens the likelihood of injury and allows users to use the device for longer periods of time.\

While particular elements, embodiments, and applications of the present invention have been shown and described, it is understood that the invention is not limited thereto because modifications may be made by those skilled in the art, particularly in light of the foregoing teachings. It is therefore contemplated by the appended claims to cover such modifications and incorporate those features which come within the spirit and scope of the invention.

I claim:

1. A post driving device including:

a handle mounted to a shaft by a first floating mount having a first floating region and a second floating mount having a second floating region, where said first floating mount and the second floating mount allow said handle to oscillate within said first floating region and said second floating region; and a first damper spring positioned proximate the closed top end of the shaft between said handle and said shaft, where said first damper spring extends into said first floating region, and where said first damper spring dampens vibration between said shaft and said handle;

a second damper spring positioned proximate the distal open bottom end of the shaft between said handle and said shaft, where said second damper spring extends into said second floating region of said second floating mount where said second damper spring dampens vibration between said shaft and said handle, and wherein the respective positioning of the first and second damper springs between the handle and shaft at the upper and lower mounting flanges isolating said handle from vibration in said shaft; and wherein said handle is floatingly attached to said first floating mount with a first nut and first bolt, where said first bolt is inserted vertically up through an aperture in said first floating mount, an aperture in said first damper spring, an aperture in said handle, and an aperture in said first nut, where said first nut secures said first bolt in place.

2. A post driving device including:

a shaft having an axially extending interior cavity, said cavity extending to a closed top end of said shaft and to a distal open bottom end of said shaft, said closed top end forming a striking surface, and said shaft having a first mounting bracket extending from an exterior wall of said shaft;

a handle having an upper mounting flange mounted to said first mounting bracket by a first floating mount having a first floating region;

a first damper spring positioned proximate the closed top end of the shaft between said upper mounting flange of said handle and said first mounting bracket, where said first damper spring extends into said first floating region such that said first damper is positioned between said handle and said shaft to dampen vibration therebetween;

wherein said upper mounting flange is floatingly attached to said first mounting bracket with a first nut and first bolt, where said first bolt is inserted vertically up through an aperture in said first mounting bracket, an aperture in said first damper spring, an aperture in said upper mounting flange, an aperture in said first nut, and an aperture in a third mounting bracket of said shaft extending from said exterior wall of said shaft, where said first nut secures said first bolt in place; and a second damper spring positioned proximate the distal open bottom end of the shaft between a lower mounting flange of said handle and a second mounting bracket extending from said exterior wall of said shaft, where said lower mounting flange is mounted to said second mounting bracket by a floating mount having a floating region, where said second damper spring extends into said floating region such that said second damper is positioned between said handle and said shaft to dampen vibration therebetween, wherein the positioning of the first and second damper springs between the handle and shaft at the upper and lower mounting flanges isolating said handle from vibration in said shaft.

3. A post driving device of comprising:

a shaft having an axially extending interior cavity, said cavity extending to a closed top end of said shaft and to a distal open bottom end of said shaft, said closed top end forming a striking surface, and said shaft having a first mounting bracket extending from an exterior wall of said shaft;

a handle having an upper mounting flange mounted to said first mounting bracket by a first floating mount having a first floating region; and a first damper spring positioned proximate the closed top end of the shaft between said upper mounting joint of said handle and said first mounting bracket, where said first damper spring extends into said first floating region such that said first damper is positioned between said handle and said shaft to dampen vibration therebetween;

a second damper spring positioned proximate the distal open bottom end of the shaft between a lower mounting flange of said handle and a second mounting bracket extending from said exterior wall of said shaft, where said lower mounting flange is mounted to said second mounting bracket by a floating mount having a floating region, where said second damper spring extends into said floating region such that said second damper is positioned between said handle and said shaft to dampen vibration therebetween;

wherein said upper mounting flange is floatingly attached to said first mounting bracket with a first nut and first bolt, where said first bolt is inserted vertically up through an aperture in said first mounting bracket, an aperture in said first damper spring, an aperture in said upper mounting flange, an aperture in said first nut, and an aperture in a third mounting bracket of said shaft extending from said exterior wall of said shaft, where said first nut secures said first bolt in place; and said lower mounting flange is floatingly attached to said second mounting bracket with a second nut and second bolt, where said second bolt is inserted vertically down through an aperture in said lower mounting flange of said handle, an aperture in said second damper spring, an aperture in said second mounting bracket, and an aperture in said second nut, where said second nut secures said second bolt in place, and wherein the respective positioning of the first and second damper springs between the handle and shaft at the upper and lower mounting flanges isolating said handle from vibration in said shaft.

4. The post driving device of claim 3, further including:

a level for determining the orientation of said shaft, where said level is physically mounted to said shaft.

5. The post driving device of claim 3, wherein said first damper spring is mechanical, such as one of a spring, hydraulic shock absorber, and pneumatic shock absorber.

6. The post driving device of claim 3, wherein said first damper spring is a material possessing vibration damper properties, such as one of rubber, foam, and elastomeric material.

7. The post driving device of claim 3, wherein said shaft is cylindrical having a circular radial cross-section.

8. The post driving device of claim 3, wherein said shaft is made of a metal.

9. A post driving device of comprising:

a handle mounted to a shaft by a first floating mount having a first floating region, where said first floating mount allows said handle to oscillate within said first floating region; and a first damper spring positioned between said handle and said shaft, where said first damper spring extends into said first floating region, and where said first damper spring dampens vibration between said shaft and said handle;

wherein said handle is additionally mounted to said shaft by a second floating mount having a second floating region, where said second floating mount allows said handle to oscillate within said second floating region, and a second damper spring positioned between said handle and said shaft, where said second damper spring extends into said second floating region of said second floating mount where said second damper spring dampens vibration between said shaft and said handle, and wherein the respective positioning of the first and second damper springs between the handle and shaft at the upper and lower mounting flanges isolating said handle from vibration in said shaft;

wherein said first floating mount includes a first mounting bracket extending from an exterior wall of said shaft, a third mounting bracket extending from said exterior wall of said shaft, a first nut and first bolt, where said first bolt is inserted vertically up through an aperture in said first mounting bracket, an aperture in said first damper spring, an aperture in an upper mounting flange of said handle, an aperture in said first nut, and an aperture in said third mounting bracket, where said first nut secures said first bolt in place, and said second floating mount includes a second mounting bracket extending from said exterior wall of said shaft, a second nut and second bolt, where said second bolt is inserted vertically down through an aperture in a lower mounting flange of said handle, an aperture in said second damper spring, an aperture in said second mounting bracket, and an aperture in said second nut, where said second nut secures said second bolt in place.

10. The post driving device of claim 9, further including:

a level for determining the orientation of said shaft, wherein said level is physically mounted to said shaft.

11. The post driving device of claim 9, wherein said first damper spring is mechanical, such as one of a spring, hydraulic shock absorber, and pneumatic shock absorber.

12. The post driving device of claim 9, wherein said first damper spring is a material possessing vibration damping properties, such as one of rubber, foam, and elastomeric material.

13. The post driving device of claim 9, wherein said shaft is cylindrical having a circular radial cross-section.

14. The post driving device of claim 9, wherein said shaft is made of a metal.

* * * * *